United States Patent [19]

Lorch et al.

[11] 4,033,884

[45] July 5, 1977

[54] CALIBRATION SOURCE

[75] Inventors: Edgar Adolf Lorch; Keith Ernest Fletcher; David Page, all of Amersham, England

[73] Assignee: The Radiochemical Centre Limited, Amersham, England

[22] Filed: Jan. 24, 1975

[21] Appl. No.: 543,908

[30] Foreign Application Priority Data

Jan. 28, 1974 United Kingdom ..... 3951/74

[52] U.S. Cl. ..... 250/496; 252/301.1 R; 250/252; 250/272

[51] Int. Cl.[2] ..... G21F 5/02

[58] Field of Search ..... 250/252, 493, 496, 272, 250/273, 320, 322, 323, 327, 493, 494, 496; 252/301.1 R

[56] References Cited

UNITED STATES PATENTS

| | | | |
|---|---|---|---|
| 1,505,209 | 8/1924 | Leach et al. | 250/496 |
| 2,575,134 | 11/1951 | Schrltz et al. | 250/496 |
| 3,337,735 | 8/1967 | Christian et al. | 250/496 |

OTHER PUBLICATIONS

Chemical Abstracts, vol. 78, 1973, 51055q (pp. 529–530).

An Attempt to Biosythesize $^{123m}$Te–Telurometh ionine, Int. J. of Applied Radiation & Isotopes, vol. 25, pp. 330–331, 1974.

An Electronically Gated Gamma & X-Ray Calibration Scheme, Nuclear Instruments & Methods, 101/1972, pp. 567–572.

*Primary Examiner*—Alfred E. Smith
*Assistant Examiner*—Tommy P. Chin
*Attorney, Agent, or Firm*—Wenderoth, Lind & Ponack

[57] ABSTRACT

A Flood Source for calibration of gamma-cameras comprises the nuclide Tellurium-123m in a solution contained uniformly within a liquid-retaining plastics sheet of uniform thickness. The plastics sheet may be enclosed in a protective metallic casing.

7 Claims, 1 Drawing Figure

CALIBRATION SOURCE

This invention relates to a calibration source for a gamma camera or scanner.

BACKGROUND OF THE INVENTION

Gamma cameras are used in medicinal applications to monitor the progress or distribution of a γ-ray emitting nuclide introduced into a patient. The camera is located adjacent the part or organ of the patient concerned, for instance the brain or liver, and the distribution of the nuclide therein is indicated by the activity at various positions within the organ recorded by the camera.

The gamma camera comprises a γ-ray sensitive crystal which gives a plurality of responses representing particular positions, and related to the position distribution and intensity of the γ-ray emitting nuclide in the patient. A multielement collimator in front of the camera is used to view the patient and direct radiation to corresponding parts of the camera during testing.

In order to render this so called diagnostic scintigraphy accurate, it is essential that the camera or scanner be accurately calibrated, so that the non-uniformity in the spatial response of the camera can be allowed for in drawing conclusions from the results of diagnostic tests. Cameras can vary in sensitivity by as much as ±15% over their areas, and need to be calibrated daily.

One way of calibrating gamma cameras is to expose them to a uniform activity in the form known as a flood source. This may conveniently comprise a disc containing a uniformly dispersed γ-emitting nuclide located in particular spaced relation to the camera to provide a uniform field, whereupon camera readings indicate the sensitivity of the various parts of the camera.

One of the most popular nuclides used for diagnostic scintigraphy by introduction into a patient is Technetium-99m which has a γ-ray of 140 KeV, but a half life of only six hours. While it would obviously be ideal to calibrate the gamma cameras using this same nuclide as is used in diagnosis, it will be appreciated that with the very short half life of Technetium-99m this is not practical. It is therefore common practice to use a so-called pseudo-standard, and for this purpose it has been known, in the case of Technetium-99m, to use Cobalt-57 which has half life of 270 days and emits γ-rays at 122 and 136 KeV, and also Gadolinium-153, which has a half life of 242 days and γ-ray lines at 99 and 101 KeV.

These nuclides both suffer from disadvantages when used as calibration nuclides for gamma cameras to be used with Technetium-99m. The Cobalt nuclide presents difficulties because 0.2% of high energy γ-radiation is emitted and because additional γ-ray lines are emitted from the common impurities of Cobalt-56 and Cobalt-58. On the other hand, it will be appreciated that the energies of Gadolinium-153 are rather remote from the 140 KeV γ-ray line of Technetium-99m.

We have now discovered that the nuclide Tellurium-123m is particularly suitable for calibrating gamma cameras which are to be used with Technetium-99m. We have discovered that this Tellurium nuclide can be readily prepared to a satisfactory purity in which it offers the advantages that it has a low level of associated high energy γ-radiation, it has a main γ-ray line at 159 KeV, and it has only this single principle γ-ray line. In addition it has a satisfactory half life of 117 days, and the 159 KeV γ-ray line is satisfactorily close to the γ-ray line of Technetium-99m.

SUMMARY OF THE INVENTION

According to the present invention therefore we provide a flood source for calibration of gamma cameras comprising the nuclide Tellurium-123 m in a solution contained uniformly within a liquid-retaining plastics sheet of uniform thickness.

We have found that the use of Tellurium-123m in a flood source provides considerable advantages which have not hitherto been appreciated. Firstly, this nuclide can be obtained in relatively pure form, and the impurities found do not emit radiations of similar energy to those of the principal nuclide, so that in general a single line γ-ray line is obtained. This is in contrast to the previously used Cobalt-57 nuclide which emits two γ-ray lines separated by only 6KeV. In addition the fact that the γ-ray line of Tellurium-123m at 159 KeV is of rather higher energy than the Cobalt lines is advantageous because spatial resolution during calibration depends upon scatter, which reduces with increasing energy. This means that a more pronounced energy peak is to be detected by the camera, thus increasing discrimination from scattered radiation.

We have discovered that suitably pure Tellurium-123m can be obtained by irradiating highly enriched Tellurium-122 in a fast neutron flux. Although the reaction 122 Te (n γ) → 123m Te has a significant cross section, the neutron absorption cross section for Tellurium-123m itself is so high that the yield obtained in a given irradiation time is reduced by "burn up"and self shielding. After irradiation it is appropriate to store the nuclide for not less than 28 days to ensure that any short lived radio nuclidic impurities such as Iodine-131 are reduced to negligible amounts. It is preferable for the Tellurium-123m which is used to have a γ-radiation spectrum containing not more than 0.2% of γ-emitting impurities having radiations above 160 KeV.

DETAILED DESCRIPTION OF THE INVENTION

Figure 1:
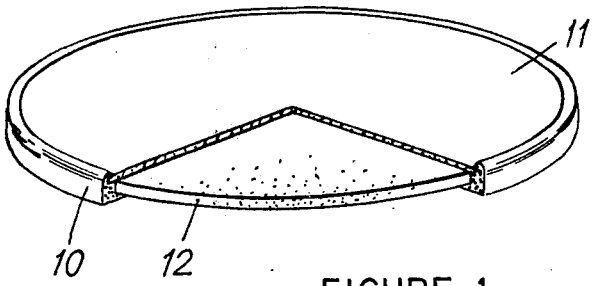
FIG. 1 is a partially cut-away view of a flood source of the present invention.

In preparing flood sources of the invention, the so obtained nuclide is first checked to detect impurities and activity using γ-ray spectroscopy. It is then dissolved in an alkaline solution such as weak caustic soda and mixed with a water soluble polyester resin. An appropriate resin is sold under the name "Autoplax" by Synthetic Resins of Liverpool. Typically, milligram quantities of the nuclide are mixed with 250 grams of the resin. A hardener is added and the resulting emulsion is poured into a massive vertical aluminium mold which must be so desiged as to minimize distortions which could lead to variations in thickness of the eventual flood source. This is obviously important because, if the thickness of the source varies, the distribution of activity over the area of source will vary. This distribution should be kept within the limits of about ±2%. A silicon wax can be used as a release agent on the walls of the mould, the mix being allowed to set at room temperature for five hours before release.

After release of the source, it is trimmed and is then in the form of a plastic disc or sheet which is porous, the nuclide being homogeneously mixed with the solution and contained in these pores. A suitable thickness of the disc is 4 mm. This method of manufacture allows accurate control of the thickness and thus of the activity, and the mixing process allows the nuclide to be homogeneously dispersed within the resultant flood source.

It is appropriate to enclose the source in an aluminium holder and that it may be stuck therein with Araldite. A lid of aluminium is then stuck on with the same material and the edges rolled over. Before despatch, the sources are measured by scanning with a $\gamma$-ray detector which is gated about the 159 KeV line emitted by Tellurium-123m. Details of this distribution scan are of course supplied with the source to the customer in order that he may compensate for any lack of uniformity in the source when calibrating his gamma camera. Clearly unsatisfactory sources can be discarded at this stage.

If desired a plastics scattering medium can be located in front of the source so as to scatter the radiation in manner similar to the emission from a patient.

An example of a flood source according to the invention is illustrated in FIG. 1 which shows a circular disc typically of 343 mm. diameter and comprising a casing of a base and rim 10 of aluminium with an aluminium cover 11. Within the disc casing is a circular disc 12 of the liquid retaining plastics containing the nuclide Tellurium-123m in solution.

We claim:

1. A flood source for calibrating gamma-cameras, said source comprising:

a plastics sheet of uniform thickness containing the nuclide tellurium-123m uniformly dispersed therein.

2. A flood source as claimed in claim 1 wherein said nuclide tellurium-123m is in a solution contained uniformly within said plastics sheet.

3. A flood source as claimed in claim 1 wherein said tellurium-123m has a gamma-radiation spectrum containing not more than 0.2% of gamma-emitting impurities having radiations above 160 KeV.

4. A flood source as claimed in claim 1 further comprising a protective holder surrounding said plastics sheet.

5. A flood source as claimed in claim 4, wherein said plastics sheet is a circular disc of uniform thickness comprised of a polyester resin containing said nuclide tellurium-123m uniformly dispersed therein; and said protective holder is an aluminum casing surrounding said circular disc.

6. A method of making a flood source for a gamma-camera, comprising:

preparing a mixture of an alkaline solution of nuclide tellurium 123m a water-soluble plastics material;

shaping said mixture into a sheet of uniform thickness and desired configuration.

7. A method of making a flood source as claimed in claim 6 wherein said mixture is molded in a mold.

* * * * *